US005265570A

United States Patent [19]

Schnaibel et al.

[11] Patent Number: 5,265,570

[45] Date of Patent: Nov. 30, 1993

[54] METHOD AND ARRANGEMENT FOR CONTROLLING THE AIR SUPPLY TO AN INTERNAL COMBUSTION ENGINE

[75] Inventors: Eberhard Schnaibel, Hemmingen; Erich Schneider, Kirchheim, both of Fed. Rep. of Germany

[73] Assignee: Robert Bosch GmbH, Stuttgart, Fed. Rep. of Germany

[21] Appl. No.: 844,621

[22] PCT Filed: Sep. 12, 1990

[86] PCT No.: PCT/DE90/00699

§ 371 Date: Mar. 30, 1992

§ 102(e) Date: Mar. 30, 1992

[87] PCT Pub. No.: WO91/05155

PCT Pub. Date: Apr. 18, 1991

[30] Foreign Application Priority Data

Sep. 30, 1989 [DE] Fed. Rep. of Germany ..... 3932763

[51] Int. Cl.[5] ..... F02M 3/00

[52] U.S. Cl. ..... 123/339

[58] Field of Search ..... 123/339, 327, 328, 352, 123/399, 402, 403

[56] References Cited

U.S. PATENT DOCUMENTS

| | | | |
|---|---|---|---|
| 4,924,835 | 5/1990 | Denz | 123/478 |
| 5,121,726 | 6/1992 | DiNunzio et al. | 123/339 |
| 5,131,360 | 7/1992 | Muschalik | 123/339 |
| 5,134,978 | 8/1992 | Binnewies et al. | 123/339 |
| 5,161,502 | 11/1992 | Fritz | 123/327 |
| 5,170,761 | 12/1992 | Kato et al. | 123/339 |
| 5,172,666 | 12/1992 | Nonaka | 123/352 |
| 5,184,588 | 2/1993 | Kato et al. | 123/339 |

FOREIGN PATENT DOCUMENTS

| | | | |
|---|---|---|---|
| 2654455 | 8/1978 | Fed. Rep. of Germany | 123/339 |
| 1603921 | 12/1981 | United Kingdom | 123/339 |

*Primary Examiner*—Raymond A. Nelli
*Attorney, Agent, or Firm*—Walter Ottesen

[57] ABSTRACT

A method and an arrangement for controlling the air supply to an internal combustion engine of a motor vehicle are proposed with filtered values being generated for the control of the actuating element position from input values formed in dependence upon operating parameters of the internal combustion engine and/or of the motor vehicle as values to be filtered and in which the speed of change of the actuating element position is variable in accordance with the input of the values to be filtered and the filtered values, in particular their difference, by influencing the filter characteristic and the transmission behavior.

18 Claims, 3 Drawing Sheets

METHOD AND ARRANGEMENT FOR CONTROLLING THE AIR SUPPLY TO AN INTERNAL COMBUSTION ENGINE

FIELD OF THE INVENTION

The invention relates to a method and an arrangement for controlling the air supply to an internal combustion engine

BACKGROUND OF THE INVENTION

Such a method and such an arrangement are known from the DE-OS 26 54 455. There, an electrical controller is proposed which, dependent on a pregiven and a measured parameter of the motor vehicle, generates a control signal for controlling the air supply to the internal combustion engine via a throttle flap. For this purpose, a delay or filter element is provided in the control line which is to ensure a smooth transition of the measured parameter value to the pregiven value in the event of changes of the pregiven value. Should a change of the pregiven value occur, which is greater than a threshold value, then this delay or filter element delays the control signal of the control unit as a function of time; whereas, the control signal arrives unchanged at the throttle flap in the case of changes below the threshold value. Such a procedure enables the desired smooth transition to be achieved, but minor fluctuations or changes in the pregiven value act, without being influenced, on the position of the throttle flap and therefore on the speed and output of the internal combustion engine, which can cause a deterioration of the driving comfort, in particular during the idling condition. Major changes, however, come into effect only after a delay, and this means a loss in dynamics of the open-loop/closed-loop control system.

It is therefore the task of the invention to create a method or an arrangement for controlling the air supply to an internal combustion engine with the maximum possible dynamics and improved driving comfort This task is solved by the procedure described in the characterizing parts of the independent patent claims. For this purpose, the speed of changing of the actuating element position and of the drive signal for the actuating element for controlling the air supply is changeable by influencing a filter characteristic and/or the transfer behavior of a filter according to the value or signal to be filtered and the filtered value or signal.

From U.S. Pat. No. 4,924,835, a method for filtering the load signal and/or the basic quantity of a fuel metering device is known. In that process, an insensitivity range is formed around the measured, uninfluenced load signal; by means of a window comparator, the filtered signal is compared with the limits of this insensitivity range, and the filtering action is switched off when the filtered signal leaves the insensitivity range.

From British Patent 1,603,921, a system for the electronic control of the throttle flap position of an internal combustion engine, dependent on a value pregiven by the accelerator pedal, is known. For the improvement of the operating behavior of the internal combustion engine, a limitation of the speed of changing of the throttle flap position is undertaken by means of a filter which is arranged between the position controller and the throttle flap drive.

SUMMARY OF THE INVENTION

The procedure in accordance with the invention has the advantage, that quiet running and driving comfort of the motor vehicle are improved, particularly in the range of the idling condition, since changes of smaller amplitudes and higher frequencies do not have any effect, while the control system can follow changes of larger amplitude with a high speed. A further advantage is to be seen in that the procedure in accordance with the invention makes it possible to achieve the improvements without intervention in the controller structure.

BRIEF DESCRIPTION OF THE DRAWINGS

FIG. 1 shows a block diagram of an arrangement for the control of the air supply to an internal combustion engine, while

DESCRIPTION OF THE PREFERRED EMBODIMENT OF THE INVENTION

Figure 1:
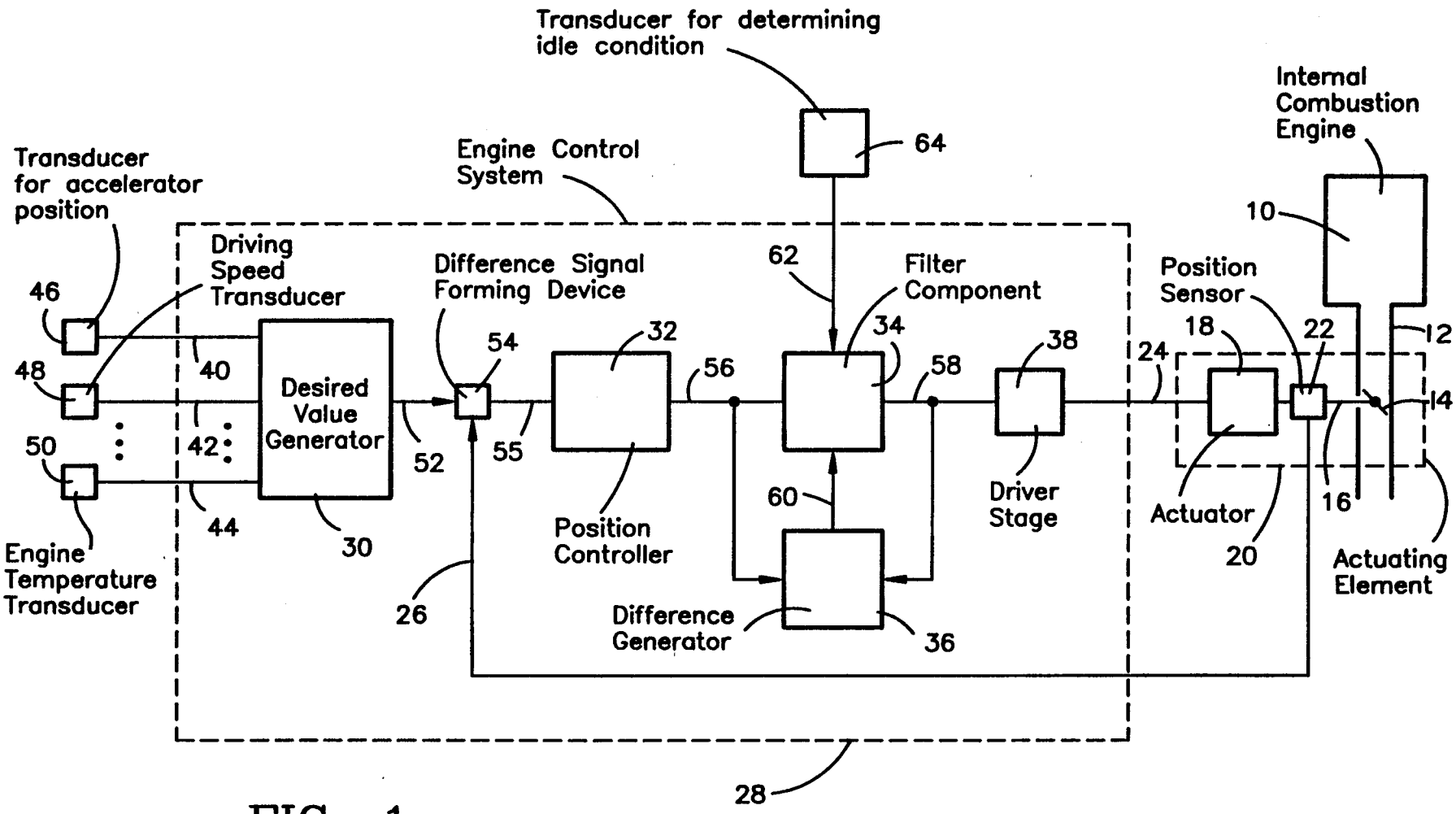

FIG. 1 shows an internal combustion engine 10 with a throttle flap 14 located in the intake pipe 12 with this throttle flap being rigidly connected to an electrically operable actuator 18 via a mechanical link 16. Throttle flap 14, mechanical link 16, and actuator 18 form the actuating element 20 for the open-loop control of the air supply to the internal combustion engine. A position sensor 22 which registers the position of the actuating element 20 is also part of the actuating element. The actuating element 20 is connected to an engine control system 28 via its input line 24 and via its output line 26. The input line 24 is led to the actuator 18 and the output line 26 is led to the position sensor 22.

The engine control system 28, which in addition to the control of the air supply as shown in FIG. 1 can also carry out the functions of fuel metering and/or ignition, comprises a desired-value generator 30, a position controller 32, a filter component 34, a difference generator 36 and a driver stage 38.

The desired-value generator 30 of the engine control system 28 is fed measuring signals of operating parameters of the internal combustion engine and the motor vehicle via the control system input lines 40, 42 to 44 from measured value transducers 46, 48 to 50. The measured value transducers 46 to 50 can, for example, be an accelerator pedal position transducer which feeds a signal representing the accelerator pedal position to the desired-value generator; an idle switch of the accelerator pedal or of the throttle flap; a driving speed transducer; an engine temperature sensor; a battery voltmeter and/or a speed sensor. The output 52 of the desired-value generator is connected to a comparison point 54, the second input of which is connected to the output line 26 of the actuating element 20, and the output 55 of which is routed to the position controller 32. The output line 56 of the position controller links, on the one hand, the position controller 32 with the filter component 34 and, on the other hand, with the difference generator 36. The output 58 of the filter component 34 is led to the driver stage 38 and to a second input of the difference generator 36. A further signal line 60 links the difference generator 36 with the filter component 34; whereas, the input line 24 of the actuating element 20 connects, as output line of the engine control system 28, the driver stage 38 to the actuating element 20. A third input line 62 connects the filter component 34 with the measured value transducer 64 which is used to determine certain operating conditions, in particular the idle condition. If the current operating condition can be determined by the measured value transducers 46, 48 to 50, then transducer 64 is omitted and line 62, if appropriate, is connected to the appropriate transducer(s) 46 to 50.

Depending on its input signals, the desired-value generator 30 forms an input value or signal for the position of the actuating element 20. If the engine control system 28 is a control system with the function of controlling the idling, then the output of the input value via the output line 52 occurs only in the idling condition identified, for example, via an idling switch in the throttle flap or in the accelerator pedal. In an electronic accelerator pedal system, the input value is formed, on the one hand, in dependence upon the accelerator pedal position, and on the other hand, in the idling condition corresponding to the idling control.

The position of the actuating element 20, as determined by the position sensor 22, is compared in the comparison point 54 with the input value, and a difference signal between input and actual value is transmitted via the line 55 to the position controller 32, which, dependent on this difference signal, generates an input value for the position of the actuating element 20 via its output line 56.

The filter component 34 can be activated via the connecting line 62 in certain operating conditions (in particular in the idling condition) and these conditions are ascertained by the measuring transducer 64. In the filter component 34, the input value of the position controller 32 is influenced as the value or signal to be filtered and as the input signal of the filter component 34 by an analog or digital filter arrangement in its variation over time in dependence upon the output signal of the difference generator 36 which is supplied via the connecting line 60. In the simplest case, the filter component 54 can be a low-pass filter of the analog type with variable time constants or of the digital type with variable filter constants.

The filtering action and characteristic, or the transmission behavior of the filter component 34 is determined by the difference generator 36. Depending on the difference between the value to be filtered (input value of the controller) on the line 56 and the filter output signal as the filtered signal on the line 58, the difference generator forms an output signal indicating the magnitude of the difference; this output signal is passed via line 60 to the filter component 34. The filter characteristic is set in such a way that with an increasing amount of the difference, the filter constants are changed such that the effect of the filter component 34 on the variation over time of the value to be filtered (input value) is reduced as the difference increases. In this connection, the filter output signal forms the drive signal of the actuator, and the signal's variation over time and speed of change is determined by the method of the invention described above.

The influencing of the filtering action and the filter characteristic or the transmission behavior of the filter can take place in an almost continuous manner or in one or more stages, depending on the predetermined ranges of the difference magnitude.

The filtered output signal is passed via the output line 58 to the driver stage 38 of the engine control system 28 and serves as a drive signal for the operation of the actuating element 20 via the output line 24 of the engine control system 28 and thus determines, among other things, the speed of change of the actuating element 20 and of the throttle flap 14 with the control signal's variation over time determining the speed of change.

In principle, the idea of the invention is not limited to the described position of the filter and the difference generator in the engine control system. The filter with the difference generator can also be inserted in the output line 24, in line 52 of the desired-value generator or in line 54 between comparison point and position controller.

Figure 2:
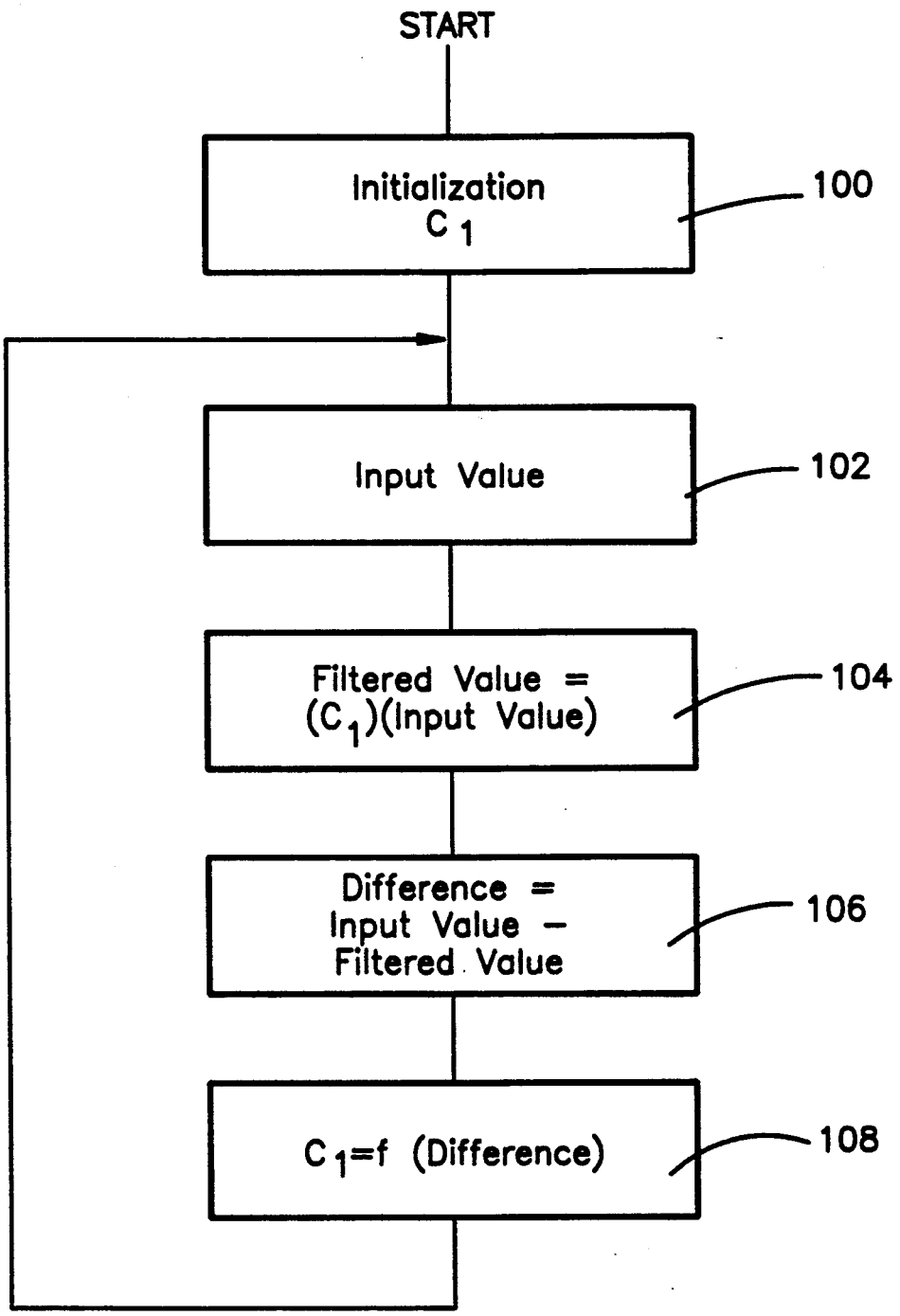
FIG. 2 represents a flowchart of the procedure according to the invention.

FIG. 2 describes by means of a flow diagram the implementation of the procedure of the invention in a computer. Following the start of the program part shown, the filter constant $C_I$ is initialized in a block 100. In function block 102, the input value issued by the controller is measured as the value to be filtered, and in block 104, the filtered value is calculated on the basis of the measured desired value and the filter constant which was loaded in the initializing step. Thereafter, in block 106, the difference is determined between the value to be filtered and the filtered value, after which, in block 108, the filter constants $C_I$ are corrected as a function of the difference established in block 106. This can be done by means of a table or a pregiven function. After working through block 108, the run of the program part starts again with block 102.

Within the confines of the concept of the invention, the filter constants $C_I$ can be a single constant (low pass) or several constants of a higher level filter.

Figure 3A:
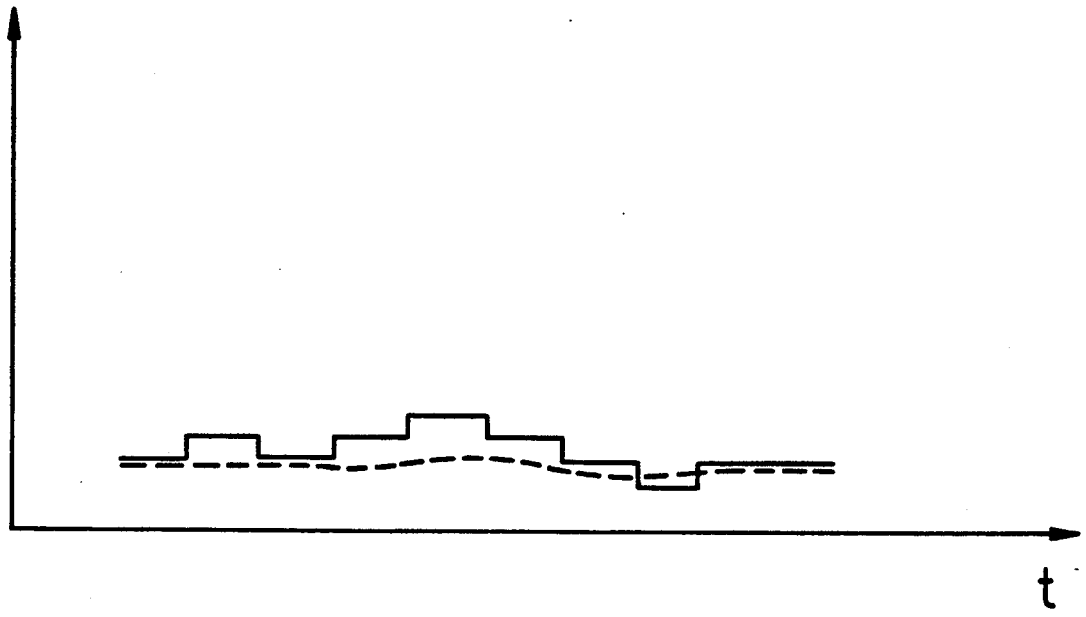
FIGS. 3A and 3B describe, by way of example, the occurring signals as functions of time.
Figure 3B:
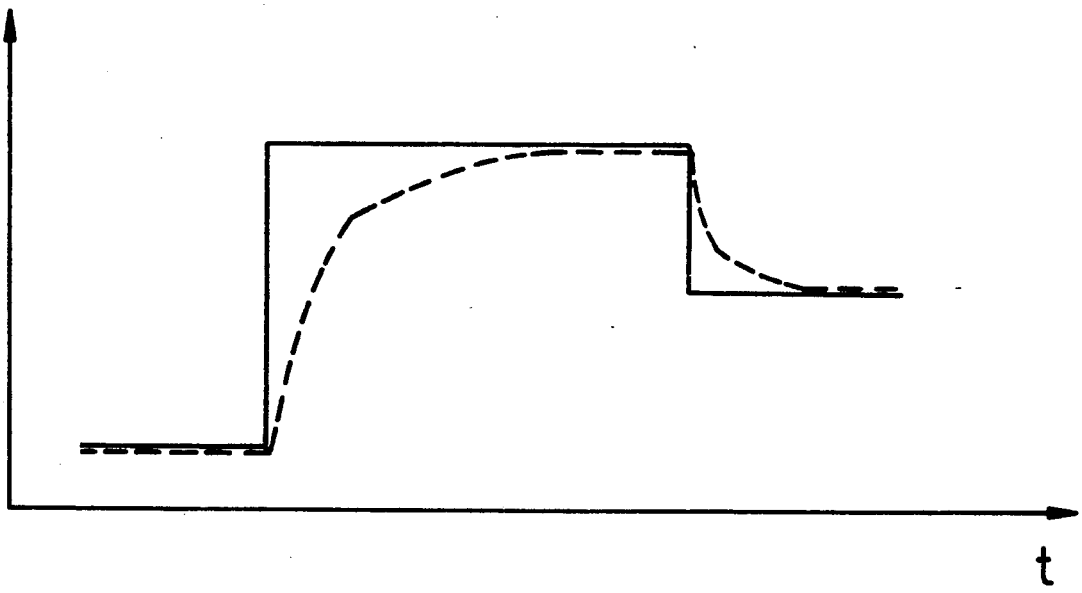

FIG. 3 shows as an example a typical trace of the stepwise changing value to be filtered (solid lines) and of the filtered value (dashed lines) for small changes of the value to be filtered (FIG. 3*a*) and for large changes of the value to be filtered (FIG. 3*b*). The horizontal axes designate the time and the vertical axes designate the signal level of the value to be filtered or of the filtered value.

FIG. 3*a* shows changes of small amplitude and higher frequency of the value to be filtered. With small differences between the value to be filtered and the filtered value, the effect of the filter is strong, so that the changes in the value to be filtered do not have any or hardly any impact on the drive signal of the actuating element 20 and therefore on the position of the throttle flap. In contrast, FIG. 3*b* shows a dynamic case of operation. The change in the value to be filtered has a large amplitude and the filtered value responds quickly to this change and reduces its speed of increase in dependence upon the difference between the value to be filtered and the filtered value by a corresponding variation of the filtering action. The position change of the throttle flap takes a course corresponding to the filtered value.

In addition to forming the difference, it is possible within the limits of the inventive idea to use a dividing, multiplying, or adding operation for the derivation of a signal which influences the filtering action.

What is claimed is:

1. A method for controlling the supply of air to an internal combustion engine of a motor vehicle, the supply of air being controlled by an electric actuating element, the method comprising the steps of:

providing a desired value generator for generating a desired value for the position of the actuating element;

detecting the actual value of the position of the actuating element with the aid of a position sensor;

comparing said desired value to said actual value to form a control deviation therefrom;

forming a drive signal for said actuating element in dependence upon said control deviation;

filtering said drive signal by applying said drive signal to a filter having a low-pass response of at least a first order and having a changeable filter constant and obtaining a filter output signal; and, determining the difference between said drive signal and said filter output signal and determining said filter constant in dependence upon said difference.

2. The method of claim 1, wherein said output signal as a function of time is dependent upon said difference between said drive signal and said filter output signal.

3. The method of claim 1, wherein said filter constant is changed in dependence upon said difference between said drive signal and said filter output signal.

4. The method of claim 3, further comprising the step of initiating the change of said filter constant when said engine is in the idle condition.

5. The method of claim 1, wherein said filter is an analog filter.

6. The method of claim 1, wherein said filter is a digital filter.

7. The method of claim 1, wherein said output signal is dependent upon the speed of the engine.

8. The method of claim 1, wherein said output signal is dependent upon accelerator pedal position.

9. The method of claim 1, wherein said output signal is dependent upon the temperature of the engine.

10. The method of claim 1, wherein said output signal is dependent upon the battery voltage.

11. The method of claim 1, wherein said output signal is dependent upon the detection of idle.

12. A method for controlling the supply of air to an internal combustion engine of a motor vehicle, the supply of air being controlled by an electric actuating element, the method comprising the steps of:

providing a desired value generator for generating a desired value for the position of the actuating element;

detecting the actual value of the position of the actuating element with the aid of a position sensor;

comparing said desired value to said actual value to form a control deviation therefrom;

forming a drive signal for said actuating element in dependence upon said control deviation;

filtering said desired value by applying said desired value to a filter having a low-pass response of at least a first order and having a changeable constant and obtaining a filter output signal; and, determining the difference between said desired value applied to said filter and the filter output signal and determining said filter constant in dependence upon said difference.

13. A method for controlling the supply of air to an internal combustion engine of a motor vehicle, the supply of air being controlled by an electric actuating element, the method comprising the steps of:

providing a desired value generator for generating a desired value for the position of the actuating element;

detecting the actual value of the position of the actuating element with the aid of a position sensor;

comparing said desired value to said actual value to form a control deviation therefrom;

forming a drive signal for said actuating element in dependence upon said control deviation;

filtering said control deviation by applying said control deviation to a filter having a low-pass response of at least a first order and having a changeable constant and obtaining a filter output signal; and, determining the difference between said control deviation applied to said filter and the filter output signal and determining said filter constant in dependence upon said difference.

14. An arrangement for controlling the air supplied to an internal combustion engine of a motor vehicle, the arrangement comprising:

an electrically actuable actuating element for controlling the supply of air to said engine;

desired value generator means for forming a desired value for the position of said actuating element;

transducer means for detecting the actual value of the position of said actuating element;

difference forming means for forming a control deviation as the difference between said desired value and said actual value;

means for forming a drive signal for driving said actuating element in dependence upon said control deviation;

filter means for filtering said drive signal to form an output signal, said filter means having a low-pass response of at least a first order and a changeable constant;

means for determining the difference between said drive signal and said output signal; and, means for determining said constant in dependence upon said difference between said drive signal and said output signal.

15. The arrangement of claim 14, said filter means and said means for determining the difference between said drive signal and said output signal being adapted to coact to cause said output signal to change in a direction opposite to said difference between said drive signal and said output signal.

16. The arrangement of claim 14, further comprising means for detecting the idle condition of said engine and for activating said filter means when said idle condition is detected.

17. An arrangement for controlling the air supplied to an internal combustion engine of a motor vehicle, the arrangement comprising:

an electrically actuable actuating element for controlling the supply of air to said engine;

desired value generator means for forming a desired value for the position of said actuating element;

transducer means for detecting the actual value of the position of said actuating element;

difference forming means for forming a control deviation as the difference between said desired value and said actual value;

means for forming a drive signal for driving said actuating element in dependence upon said control deviation;

filter means for filtering said desired value to form an output signal, said filter means having a low-pass response of at least a first order and a changeable constant;

means for determining the difference between said desired value and said output signal; and, means for determining said constant in dependence upon said difference between said desired value and said output signal.

18. An arrangement for controlling the air supplied to an internal combustion engine of a motor vehicle, the arrangement comprising:

an electrically actuable actuating element for controlling the supply of air to said engine;

desired value generator means for forming a desired value for the position of said actuating element;

transducer means for detecting the actual value of the position of said actuating element;

difference forming means for forming a control deviation as the difference between said desired value and said actual value;

means for forming a drive signal for driving said actuating element in dependence upon said control deviation;

filter means for filtering said control deviation to form an output signal, said filter means having a low-pass response of at least a first order and a changeable constant;

means for determining the difference between said control deviation and said output signal; and, means for determining said constant in dependence upon said difference between said control deviation and said output signal.

* * * * *